US008904648B2

(12) United States Patent
Tsai

(10) Patent No.: US 8,904,648 B2
(45) Date of Patent: Dec. 9, 2014

(54) HYDRAULIC HOSE CUTTING DEVICE

(75) Inventor: Szu-Fang Tsai, Changhua (TW)

(73) Assignee: Tektro Technology Corporation, Changhua (TW)

( * ) Notice: Subject to any disclaimer, the term of this patent is extended or adjusted under 35 U.S.C. 154(b) by 328 days.

(21) Appl. No.: 13/571,350

(22) Filed: Aug. 10, 2012

(65) Prior Publication Data

US 2014/0041175 A1 Feb. 13, 2014

(51) Int. Cl.
*B26B 17/00* (2006.01)
*B25F 1/00* (2006.01)

(52) U.S. Cl.
USPC ..... 30/92; 30/131; 7/157

(58) Field of Classification Search
USPC ..... 30/92, 112, 131, 134, 135, 278; 7/157
See application file for complete search history.

(56) References Cited

U.S. PATENT DOCUMENTS 4,811,441 A * 3/1989 Potesta ..... 7/158
4,938,215 A * 7/1990 Schulman et al. ..... 606/120
2012/0102752 A1* 5/2012 Steele et al. ..... 30/92

* cited by examiner

*Primary Examiner* — Stephen Choi

(57) ABSTRACT

A cutting device includes a first part and a second part which is pivotably connected to the first part. A first fixing portion is located in the top side of the first part. The second part has a second fixing portion defined in the underside side thereof and facing the top side of the first part. The second fixing portion is located corresponding to the first fixing portion. A reception slot is defined axially in the second part and communicates with the second fixing portion and the underside of the second part. A blade is inserted into the reception slot. A hole is defined through the first part for receiving a hydraulic hose. A pressing member is pivotably located in a recess in one side of the first part and is able to press the hydraulic hose passing through the hole and the recess.

4 Claims, 7 Drawing Sheets

HYDRAULIC HOSE CUTTING DEVICE

BACKGROUND OF THE INVENTION

1. Field of the Invention

The present invention relates to a cutting device, and more particularly, to a cutting device for cutting hydraulic hoses used on bicycles.

2. Description of Related Art

The conventional cutting device for cutting hydraulic hoses used on bicycles, especially for the hydraulic hoses of the bicycle brake unit is required to cut the hydraulic hoses effectively and neat.

A conventional cutting device for cutting hydraulic hoses of bicycles is commercially available and another conventional device discloses sealing techniques for sealing the hydraulic hose after being cut.

The conventional cutting device has only one function that is to cut the hydraulic hoses and the sealing techniques disclosed above is solely for sealing the hoses. In other words, the users have to carry the two different tools to cut and seal the hydraulic hoses. Besides, the cutting device disclosed above cuts the hydraulic hoses in the direction that is perpendicular to the axis of the hoses so that the resistance is significant. The sealing techniques disclosed above are operated by rotating the hoses and this is difficult to operate.

The present invention intends to provide a hydraulic hoses cutting device which improves the existed shortcomings of the conventional cutting devices.

SUMMARY OF THE INVENTION

It is therefore one object of the invention to provide a cutting device comprising a first part having a first connection portion on a top side of a first end thereof and a first fixing portion is located beside the first connection portion. A second part has a second connection portion on a first end thereof and the second connection portion is pivotably connected to the first connection portion. A second fixing portion is defined in the underside side of the second part and faces the top side of the first part. The second fixing portion is located corresponding to the first fixing portion. A reception slot is defined axially in the second part and communicates with the second fixing portion. The reception slot communicates with the underside of the second part. A blade is inserted into the reception slot and the cutting edge of the blade is not exposed beyond the underside of the second part.

A hole is defined through the first part and communicates with the top side and the underside of the first part. The first part has a recess defied in one side thereof and a pressing member is located in the recess. The hole communicates with the recess. A hydraulic hose passes through the hole and is pressed by the pressing member. A push rod is connected to the underside of the second part and located corresponding to the hole, wherein the push rod has a rounded head.

The above and other objects, features and advantages of the invention will become apparent from the following detailed description taken with the accompanying drawings.

DETAILED DESCRIPTION OF THE INVENTION

Figure 1:
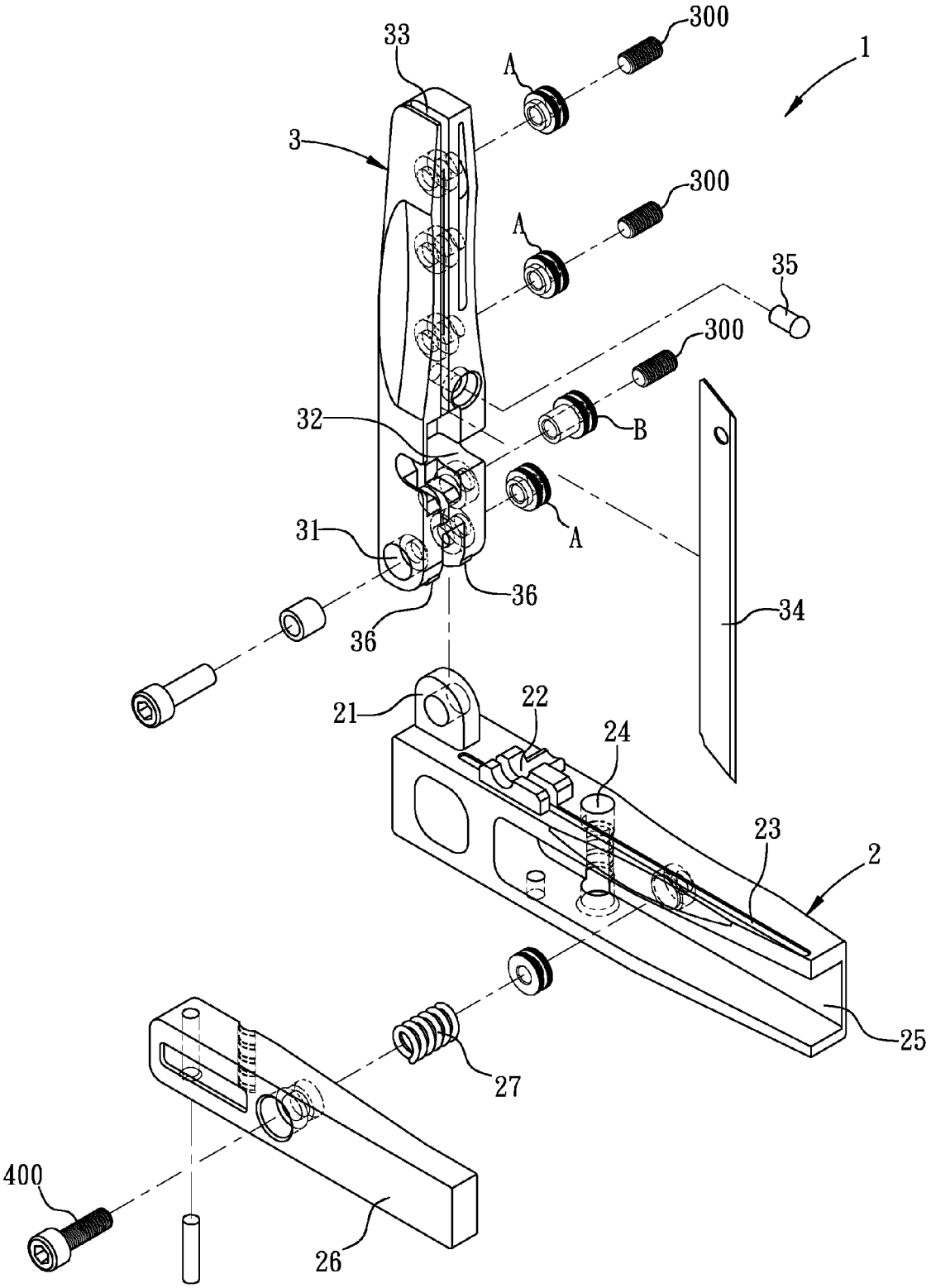
FIG. 1 is an exploded view to show the cutting device of the present invention.
Figure 2:
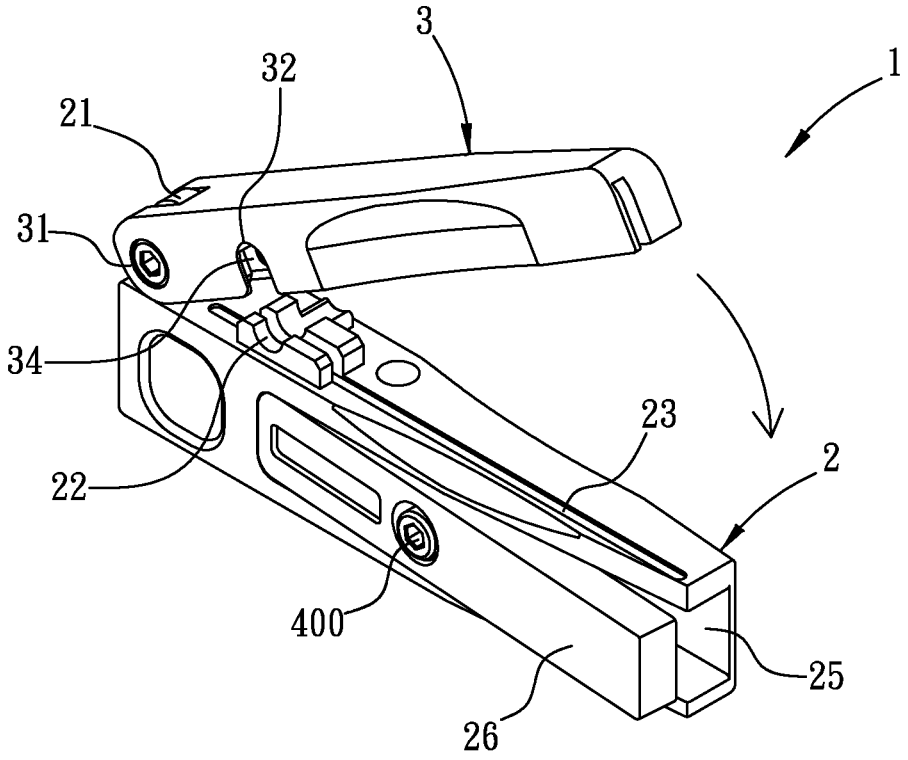
FIG. 2 is a perspective view to show the cutting device of the present invention.
Figure 3:
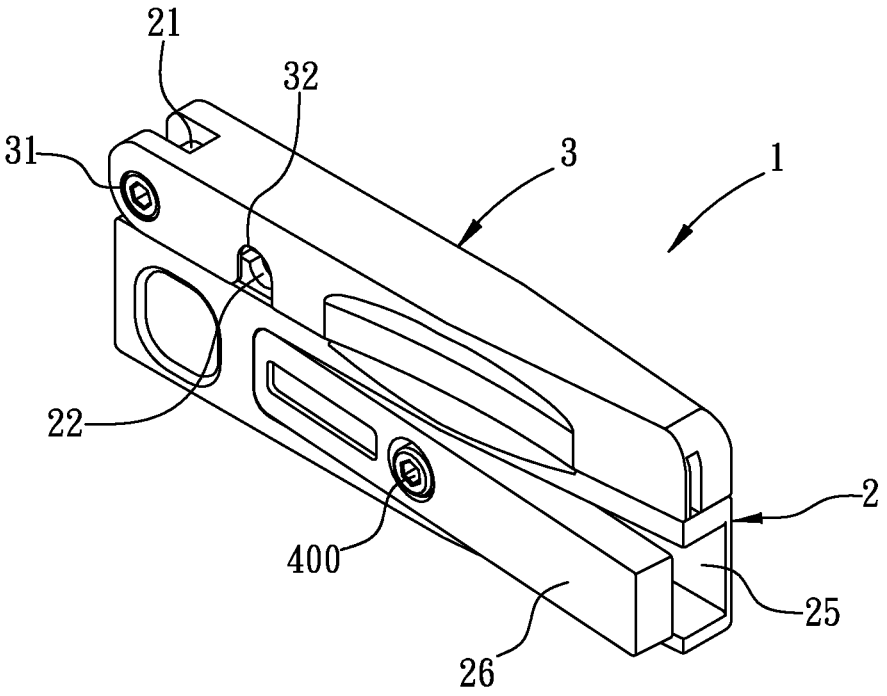
FIG. 3 is a perspective view to show that the second part is pivoted toward the first part of the cutting device of the present invention.

Referring to FIGS. 1 to 4, the cutting device 1 of the present invention comprises a first part 2 and a second part 3, wherein the first part 2 has a first connection portion 21 on the top side of the first end thereof and a first fixing portion 22 is located beside the first connection portion 21. An elongate slot 23 is defined axially in the top side of the first part 2 and communicates with the first fixing portion 22.

Figure 5:
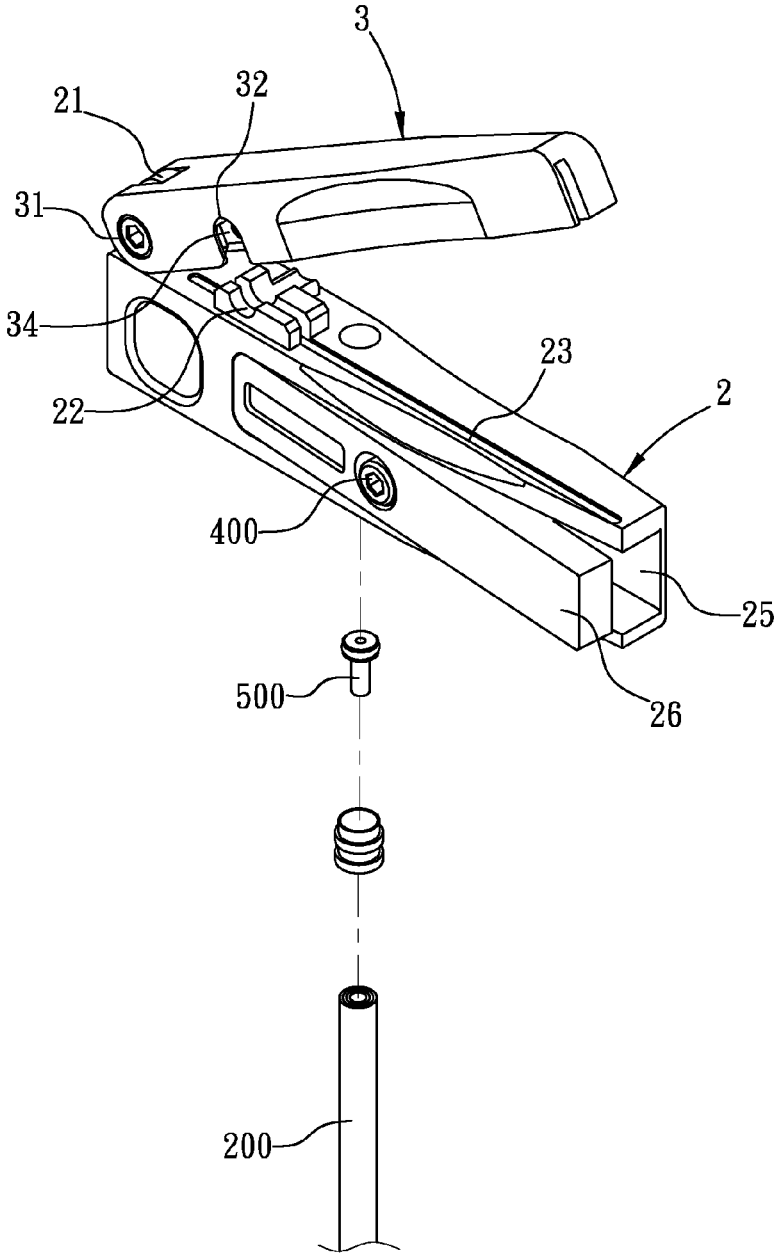
FIG. 5 shows that the hydraulic hose is cut and to be sealed.
Figure 6:
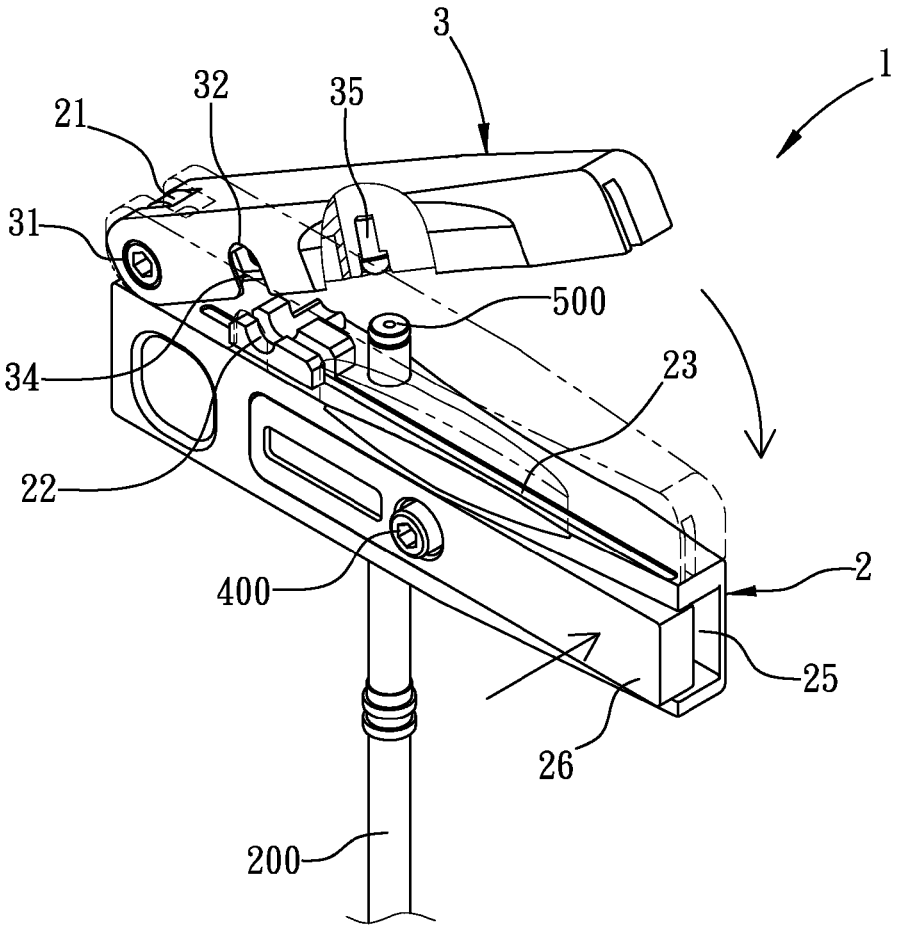
FIG. 6 shows that the hydraulic hose is cut and to be sealed by using the cutting device of the present invention.

A hole 24 is defined through the first part 2 and communicates with the top side and the underside of the first part 2. The first part 2 has a recess 25 defied in one side thereof and a pressing member 26 is located in the recess 25. The hole 24 communicates with the recess 25. The cut hydraulic hose 200 passes through the hole 24 and is pressed by the pressing member 26 as shown in FIGS. 5 and 6.

Figure 4:
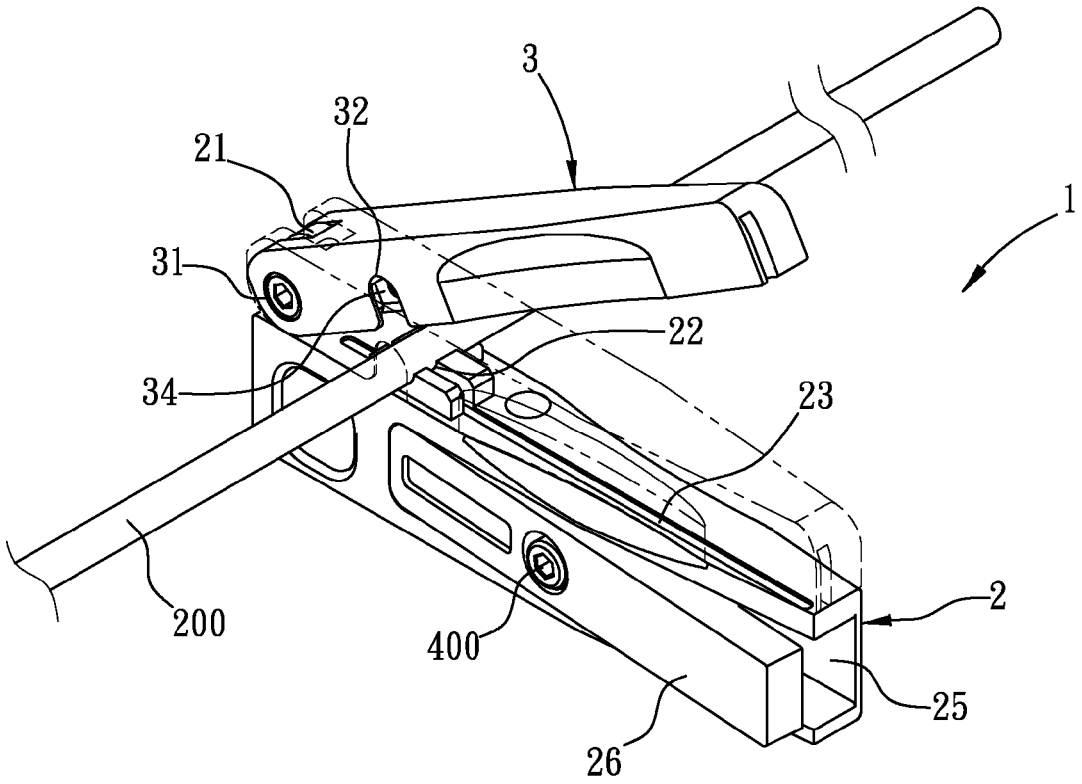
FIG. 4 shows that a hydraulic hose is located between the first and second parts of the cutting device of the present invention.

The second part 3 has a second connection portion 31 on the first end thereof and the second connection portion 31 is pivotably connected to the first connection portion 21. A second fixing portion 32 is defined in the underside side of the second part 3 and faces the top side of the first part 2. The second fixing portion 32 is located corresponding to the first fixing portion 22. The hydraulic hose 200 is positioned between the first and second fixing portions 22, 32 as shown in FIG. 4. A reception slot 33 is defied axially in the second part 3 and communicates with the second fixing portion 32. The reception slot 33 also communicates with the underside of the second part 3. A blade 34 is inserted into the reception slot 33 and the cutting edge of the blade 34 is exposed in the second fixing portion 32, but the cutting edge is not exposed beyond the underside of the second part 3. At least two bolts 300 are used to secure the blade 34. In this embodiment, there are three bolts 300 are used and two of them are located on two ends of the second fixing portion 32. The blade 34 can be replaced or removed the dulled section.

A push rod 35 is connected to the underside of the second part 3 and located corresponding to the hole 24, the push rod 35 has a rounded head.

To protrusions 36 extend from the outside of the second connection portion 31. When the second part 3 is pivoted relative to the first part 2, the two protrusion 36 are in contact with the first part 2 to restrict the angle between the first and second parts 2, 3, such as 30 degrees, to avoid the user's finger from entering the second fixing portion 32 and cut by the blade 34.

The pressing member 26 has a first pivotably connected to the first part 2 and is located in the recess 25. A resilient member 27 such as a spring is located between the pressing member 26 and the inside of the recess 25. A bolt 400 extends through the pressing member 26 and the resilient member 27 and is fixed to the first part 2. The pressing member 26 is pivoted about the first end thereof and the pressing member 26 is biased by the resilient member 27.

When using a hydraulic hose 200, the hydraulic hose 200 is in contact with the first fixing portion 22 of the first part 2 as shown in FIG. 1 and the second part 3 is pivoted toward the first part 2. The blade 34 that exposed in the second fixing portion 32 cuts the hydraulic hose 200 as shown in FIG. 4.

An end piece 500 is inserted into the hydraulic hose 500 after the hydraulic hose 500 is cut. The cut hydraulic hose 500 extends through the hole 24 protrudes from the top side of the first part 2. The pressing member 26 is then pushed to press onto the hydraulic hose 200. The second part 3 is then pivoted toward the first part 2 to push the end piece 500 into the hydraulic hose 200 by the push rod 35 to ensure the hydraulic liquid does not leak.

Alternatively, by rotating the bolt 400, the pressing member 26 is pivoted to adjust the pressing action to the hydraulic hose 200 without the use of the resilient member 27.

Figure 7:
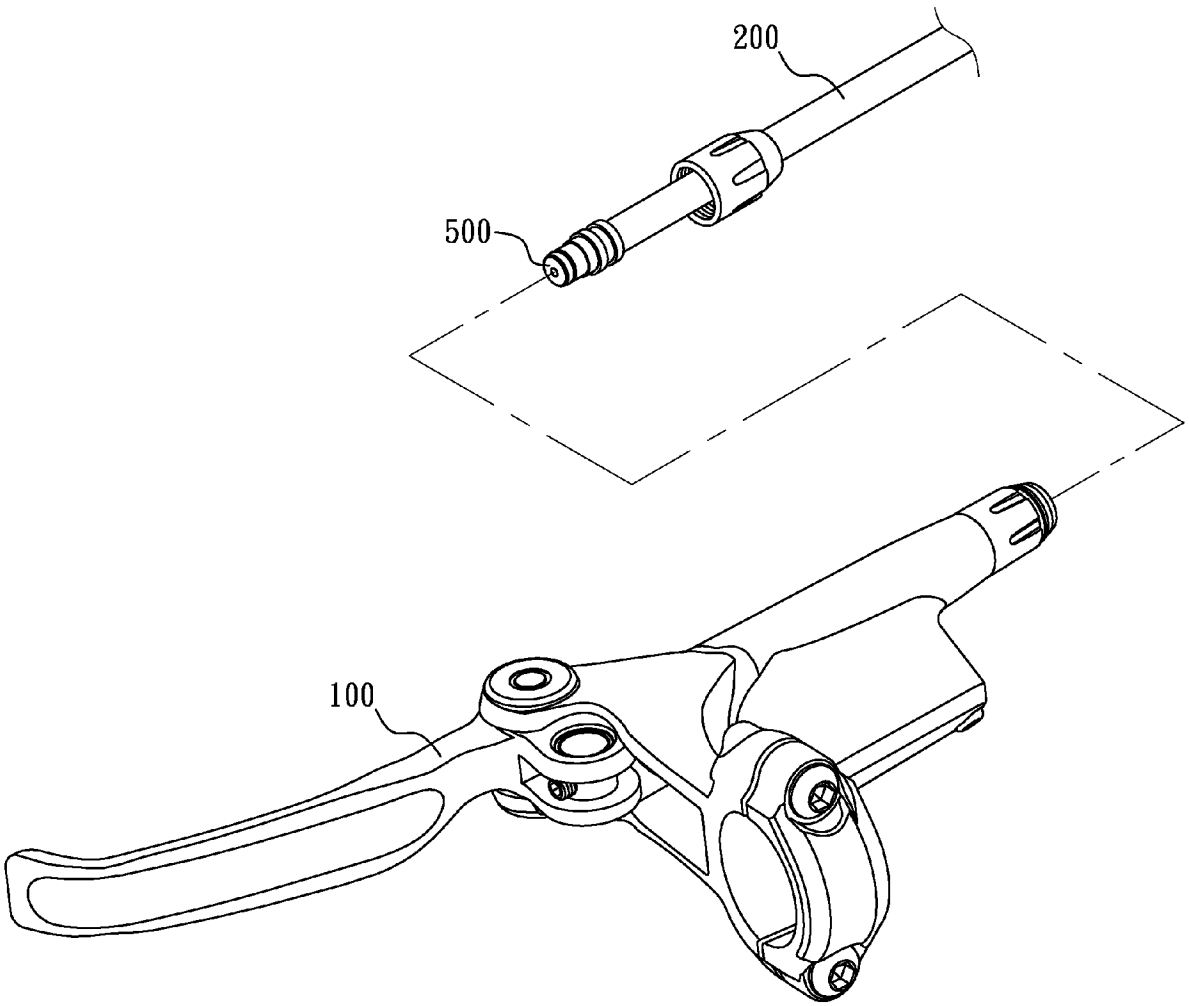
FIG. 7 shows that the cut hydraulic hose is to be connected to the bicycle brake unit.

After the end piece 500 is connected to the hydraulic hose 200, the hydraulic hose 200 with the end piece 500 can be installed to the brake unit 100 as shown in FIG. 7. Of course, the present invention can be used to cut different types of hydraulic hoses.

The first fixing portion 22 is an open-type fixing portion so as to position the hydraulic hoses of different sizes. Besides, the cutting is made by pivoting the second part 3 toward the first part 2, so that the blade 34 cuts the hydraulic hose 200 at an angle which generates less resistance.

The cutting edge of the blade 34 is exposed in the second fixing portion 32, but the cutting edge is not exposed beyond the underside of the second part 3, so that the users are not cut by the cutting edge.

Furthermore, the rounded head of the push rod 35 is easily adjusted its contact area with the end piece 500 to evenly install the end piece 500 in the hydraulic hose 200.

While the invention has been described in terms of preferred embodiments, those skilled in the art will recognize that the invention can be practiced with modifications within the spirit and scope of the appended claims.

What is claimed is:

1. A cutting device comprising:

a first part having a first connection portion on a top side of a first end thereof, and a first fixing portion located beside the first connection portion; and a second part having a second connection portion on a first end thereof and the second connection portion pivotably connected to the first connection portion, a second fixing portion defined in an underside side of the second part and facing the top side of the first part, the second fixing portion located corresponding to the first fixing portion, a reception slot defied axially in the second part and communicating with the second fixing portion, the reception slot communicating with the underside of the second part, a blade inserted into the reception slot, and a cutting edge of the blade being not exposed beyond the underside of the second part;

wherein a hole is defined through the first part and communicates with the top side and an underside of the first part, the first part has a recess defied in a side thereof and a pressing member is located in the recess, the hole communicates with the recess, a hydraulic hose passes through the hole and is pressed by the pressing member, a push rod is connected to the underside of the second part and located corresponding to the hole, the push rod has a rounded head.

2. The cutting device as claimed in claim 1, wherein the pressing member has a first pivotably connected to the first part and located in the recess, a resilient member is located between the pressing member and an inside of the recess, a bolt extends through the pressing member and the resilient member and is fixed to the first part, the pressing member is pivoted about the first end thereof and the pressing member is biased by the resilient member.

3. The cutting device as claimed in claim 2, wherein the hydraulic hose is compressed by the pressing member when the pressing member compresses the resilient member.

4. The cutting device as claimed in claim 1, wherein the pressing member has a first pivotably connected to the first part and located in the recess, a resilient member is located between the pressing member and an inside of the recess, a bolt extends through the pressing member and the resilient member and is fixed to the first part, the pressing member is pivoted by rotating the bolt.

* * * * *